US005623801A

United States Patent [19]

Drumbl

[11] Patent Number: 5,623,801

[45] Date of Patent: Apr. 29, 1997

[54] DEVICE FOR COVERING A WALL OPENING

[76] Inventor: Otto Drumbl, Bockkellerstrasse 8, Wien, Austria, A-1190

[21] Appl. No.: 244,843

[22] PCT Filed: Dec. 17, 1992

[86] PCT No.: PCT/AT92/00170

§ 371 Date: Jun. 16, 1994

§ 102(e) Date: Jun. 16, 1994

[87] PCT Pub. No.: WO93/12310

PCT Pub. Date: Jun. 24, 1993

[30] Foreign Application Priority Data

Dec. 19, 1991 [AT] Austria ..... 2530/91

[51] Int. Cl.[6] ..... E04F 19/08

[52] U.S. Cl. ..... 52/514; 52/511; 52/220.8; 52/DIG. 4; 49/463; 248/206.5

[58] Field of Search ..... 52/DIG. 4, 511, 52/513, 514, 385, 386, 220.8; 49/463, 465, 478.1, 62; 248/467, 206.5

[56] References Cited

U.S. PATENT DOCUMENTS

| | | | |
|---|---|---|---|
| 3,245,165 | 4/1966 | Podoloff | 248/467 X |
| 3,982,370 | 9/1976 | Buffington | 52/511 |
| 4,077,169 | 3/1978 | Thaw et al. | 52/745.09 |
| 4,250,596 | 2/1981 | Hara et al. | 52/DIG. 4 X |
| 4,592,180 | 6/1986 | Gerritsen | 52/DIG. 4 X |
| 4,910,937 | 3/1990 | Sperling | 52/511 |

FOREIGN PATENT DOCUMENTS

| | | | |
|---|---|---|---|
| 0397585 | 11/1990 | European Pat. Off. . | |
| 2364320 | 9/1982 | France . | |
| 0325283 | 10/1975 | Germany . | |
| 0355281 | 8/1977 | Germany . | |
| 0375128 | 7/1984 | Germany . | |
| 3302042 | 7/1984 | Germany | 52/217 |
| 3544846 | 12/1985 | Germany . | |
| 3544847 | 12/1985 | Germany . | |

*Primary Examiner*—Carl D. Friedman
*Assistant Examiner*—Winnie Yip
*Attorney, Agent, or Firm*—Salter & Michaelson

[57] ABSTRACT

A device for covering an opening in a masonry provided on its surface with tiles or plates comprises a holding member (7) for a permanent magnet (8) which cooperates with a ferromagnetic member provided on the inner side of the cover member covering the opening and provided with tiles or plates. The holding member (7) is provided via a predetermined breaking point (12) with a protrusion with a threaded bolt (6) which can be screwed into the threaded bore (5) of a frame surrounding the opening to be covered. After detaching the protrusion along the predetermined breaking point (12), the holding member (7) can be connected with an anchoring member anchorable in the masonry, which anchoring member comprises a plate-shaped section which can be inserted into a slot (15) of the holding member (7) (FIG. 3).

8 Claims, 2 Drawing Sheets

DEVICE FOR COVERING A WALL OPENING

BACKGROUND AND SUMMARY OF THE INVENTION

The invention relates to a device for covering a wall opening, for example a breaking-through or a niche, in a wall having a tile or plate cladding on its surface.

It is already known to cover wall openings by a cover having on its outer side at least one tile or plate and consisting on its inner side at least partially of a ferromagnetic material and being held by permanent magnets cooperating with the ferromagnetic material and being provided on support members fixed on the edge of the wall opening. In such a manner a practically invisible covering of the opening is obtained because the cover member is provided on its outside with the same tiles or plates as the wall, in particular, if the joints of the tile cladding corresponds to the edge of the opening.

It is already known from the AT-PS 325,283 to dispose a frame consisting of elbows connected by connection elements within the area of the edge of the wall opening, the size of this frame being changeable and adaptable to the corresponding tile size. Permanent magnets are fixed to the elbows and cooperate with a ferromagnetic element provided on the backside of a plate-shaped cover member. Such a covering device has been shown very suitable in practice, because the frame due to its variability can be disposed exactly within the joints of the tiles and provides the covering device with the necessary stability so that it is avoided that the cover falls out in an undesired manner if it is subjected to an unintentional pressure.

However, difficulties arise if tiles or plates of big size are used, because in such a case the connection pieces connecting the elbows must be so long that the stability of the frame is no more given. Such tiles or plates of big size, for example of natural marble stone, are more and more used.

Further, it has been already proposed to fix holding elements for permanent magnets only on certain places of the edge of the wall opening, for example in the area of the corners of this wall opening. For example, it is known to anchor separate elbow elements in the wall which are provided with fixing tongues and carry the permanent magnets, or to provide separate L-shaped or S-shaped bent sheet metal strips on the side edges of the openings, which strips with their one leg are fixed to a tile confining the opening and on their other leg extending into the opening carry a permanent magnet ( AT-PS 375,128, AT-PS 355,281, FR-PS 2,364,320). Such covering devices can be used for openings of any size and for any desired size of the tiles or plates, however they show the disadvantage that they are difficult to mount and that a very exact and careful work is necessary because each elbow element or each sheet metal strip must be anchored separately, no closed frame being provided that can be inserted as a whole. Because no such closed frame is present, also the stability of this known covering devices is decreased.

From the AT-PS 375,128 it is further known to dispose the permanent magnets separately in a box-shaped seat of a carrier element consisting of a bent sheet metal strip and to fix them by means of inwardly bent brackets.

Lastly, magnetic door closures are known per se, for example for furniture pieces, refrigerators Or the like, which closures consist of a permanent magnet and a ferromagnetic element cooperating with this permanent magnet.

The present invention has at its object to provide for a device for covering a wall opening that combines the advantages of the known devices and can be used for smaller openings or tile or plate sizes as well as for bigger openings or tile or plate sizes. To solve this problem, the invention proposes a device of the initially described kind which is characterized by the combination of the following features known per se:

a) a cover member provided on its outer side with at least one tile or plate and on its inner side with at least one ferromagnetic element:

b) a frame of adjustable size surrounding the wall opening and being anchorable in the masonry;

c) some permanent magnets for fixing the ferromagnetic element of the cover member;

d) a holding member for each permanent magnet with a connecting means for connection with the frame;

e) for each holding member an anchoring member each individually fixable on the masonry.

By the inventive embodiment it is possible to connect the holding members for the permanent magnets at choice by means of the connection means to the frame or to the anchoring members individually fixable to the masonry, so that for smaller openings or tile sizes or plate sizes the frame can be used which provides the covering device the necessary stability and ensures an easy mounting, however, for bigger openings or tile sizes or plate sizes, that is in the case if a frame due to the necessary size cannot more be used economically and the big size of the tiles or plates anyhow ensures the necessary stability, each carrier element can be connected to the masonry by an own anchoring member.

A preferred embodiment of the inventive apparatus is characterized in that the holding member connecting means comprises a protrusion with a threaded bolt which can be screwed into a threaded bore on the frame, and that a predetermined breaking point is provided between the holding member and the protrusion. When using the holding member together with the frame, the connection can be made in a simple manner by screwing the threaded bolt into the threaded bore on the frame, this having the advantage that by pivoting the threaded bolt the position of the cover member can be adjusted to the thickness of the used tiles or plates. When using the holding member for a permanent magnet in connection with a separate own anchoring member, within this embodiment the protrusion with the threaded bolt can be removed by a simple buckling along the predetermined breaking point.

Suitably, the holding member comprises a slot for accommodating a section of the anchoring member. Such an embodiment is simple and nevertheless it enables a reliable anchoring of the holding member in the anchoring member.

In order to ensure a connection which cannot be shifted and is correct in its position, an interlocking connection may be provided between a plate-shaped section of the anchoring member and the slot in the holding member, which connection may comprise knobs which snap into deepenings or recesses. Within this, the knobs suitable are formed by bulges in the plate-shaped section of the anchoring member, and the deepenings are formed by apertures extending from the slot of the holding member. Vice versa, however, also the knobs may be provided in the holding member and the deepenings in the plate-shaped section of the anchoring member.

In order to ensure a simple fixing of the anchoring member in the masonry in the required position, according to a further feature of the invention, the anchoring member is of step-shaped shape and consists of the plate-shaped section, a fastening section for fixing to the masonry disposed in a plane extending parallelly to the plate-shaped section, and connection section connecting the plate-shaped section and the fastening section. Thereby it is obtained that the plate shaped section and the fastening section which can be fixed to the masonry are disposed in different planes extending parallel to each other. In this case, the fastening section may be shifted into the mortar bed or adhesive bed between the surface of the masonry and the tile or plate, and by the feature that the plate-shaped section of the anchoring member which can be inserted into the slot of the holding member is backwardly displaced with respect to the plane of the masonry, the necessary space for accommodation of the holding member and of the permanent magnet connected with this holding member is at disposal, and the tiles or plates fixed to the masonry flush with the tiles or plates fixed to the cover member.

In order to ensure that a distance is observed between the tiles or plates fixed to the masonry and the tiles or plates provided on the cover member, which distance corresponds to the width of the joints between the tiles or plates, according to a further feature of the invention the connection section is provided with at least one tongue extending beyond the fastening section fixable to the masonry and, when installed into the masonry, extending perpendicularly to the surface of the masonry, the thickness of which tongue corresponds to the joint between neighbouring tiles or plates.

A good anchoring in the masonry wall is obtained, if according to the invention the fastening section of the anchoring member fixable to the masonry is provided with apertures through which the mortar or adhesive penetrates by which the tiles are fixed to the masonry.

BRIEF DESCRIPTION OF THE DRAWING

In the drawing the invention is schematically shown by way of an examplative embodiment.

DETAILED DESCRIPTION OF THE PREFERRED EMBODIMENTS

Figure 1:
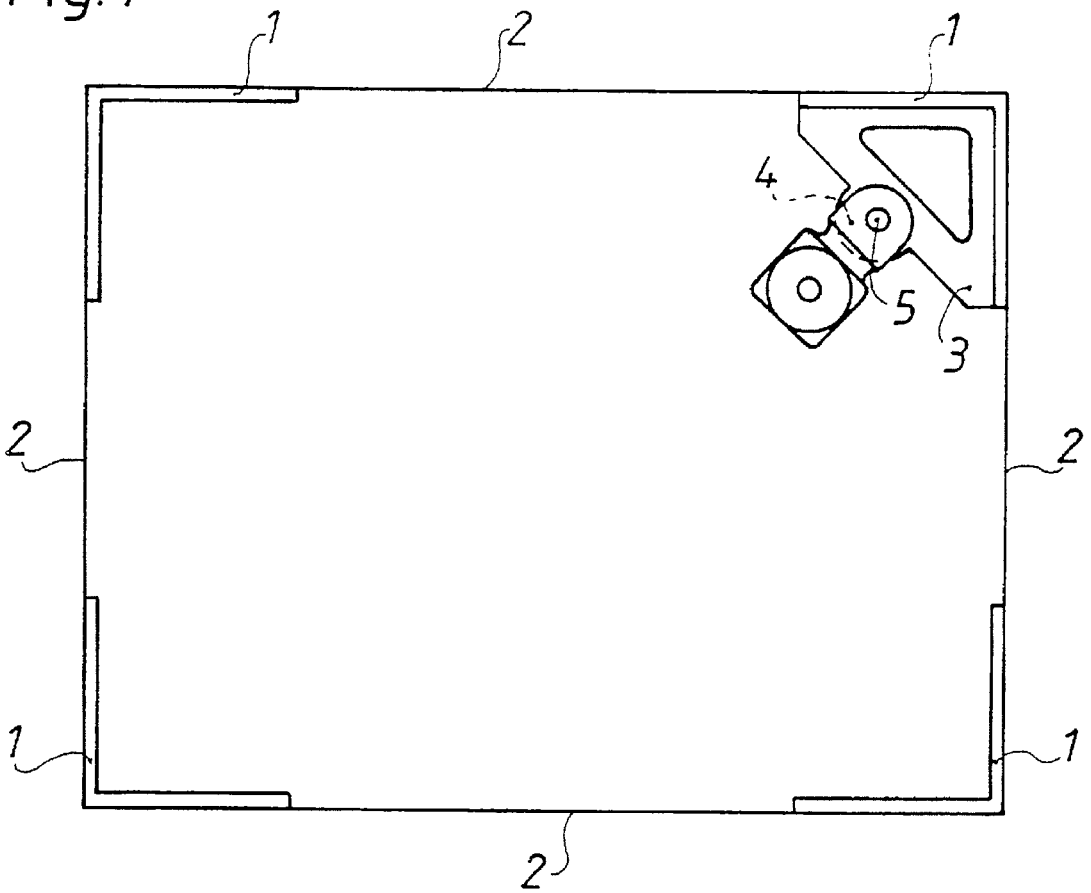
FIG. 1 shows a view of the inventive apparatus in connection with a frame.
Figure 2:
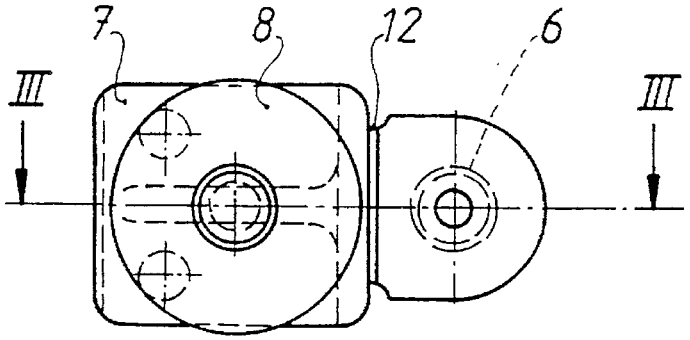
FIG. 2 shows in top view and in an enlarged scale the holding member for the permanent magnet provided at a frame.
Figure 3:
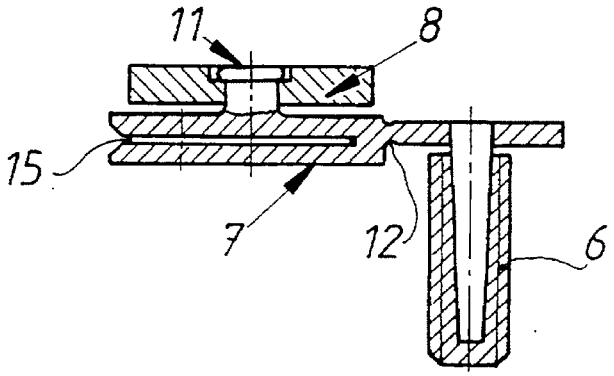
FIG. 3 shows a section taken along the line III—III of FIG. 2.

Within the embodiment shown in FIGS. 1 to 3, the device comprises a frame consisting of four frame corners 1 in which connection elements 2 are slidable guided so that the size of the frame can be varied and adapted to the size of the tiles or plate is used. By using connection elements of different length, this size of the frame can be varied to a large extent. Such a frame is known from the AT-PS 325,283 and is described there more in detail. As is wellknown in the art, and disclosed in AT-PS 325,283, the support frame assembly having frame corners 1 and connection elements 2 is adapted to be anchored in the masonry underneath the respective facing tiles or plates. The frame assembly includes peripheral strip means arranged to extend, in an applied state, peripherally of and in a generally flush fashion with inside walls of the opening, and a plurality of brackets. The brackets are complementary with the strip means for attachment to the strip means such that, in an applied state, each bracket extends from the respective side wall or from a corner between adjacent walls, transversely inwardly into the opening thus forming a first embodiment of support elements.

All frame corners 1 are equal to each other, however, in the drawing only the right upper frame corner is shown in detail for simplification's sake. The two legs of the corner 1 are connected to each other by a diagonal brace 3 provided with a protrusion 4 in which a threaded bore 5 is provided. A threaded bolt 6 of a holding member 7 for a permanent magnet 8, shown more in details in the FIGS. 2 and 3, is screwed into this threaded bore

5. This can be referred to as the "first connecting means" of the present invention. The permanent magnet 8 cooperates with small plates 9 of ferromagnetic material, not shown in FIG. 1, however visible in FIG. 4, which plates are provided on the back side of a cover member formed by a tile or plate 10 or on its outer side provided with at least one tile or plate, and this in those sections in which the permanent magnets 8 are disposed. However, of course, also the entire back side of the cover member may be formed by a plate of ferromagnetic material, what in particular is suitable, if some tiles or plates are provided on the outside of the cover member, because then this ferromagnetic plate constitutes the carrier member for these some tiles or plates. The ferromagnetic plates 9 present one embodiment of what is generally referred to as "ferromagnetic surface portion 9 extending over at least a part of the overall area of the inner surface of the plate".

The permanent magnet 8 is fixed to the holding member 7 by means of a protruding plug 11 which penetrates an opening of the permanent magnet 8 and has a thickening on its free end which avoids that the permanent magnet 8 can slide off the plug 11.

Figure 4:
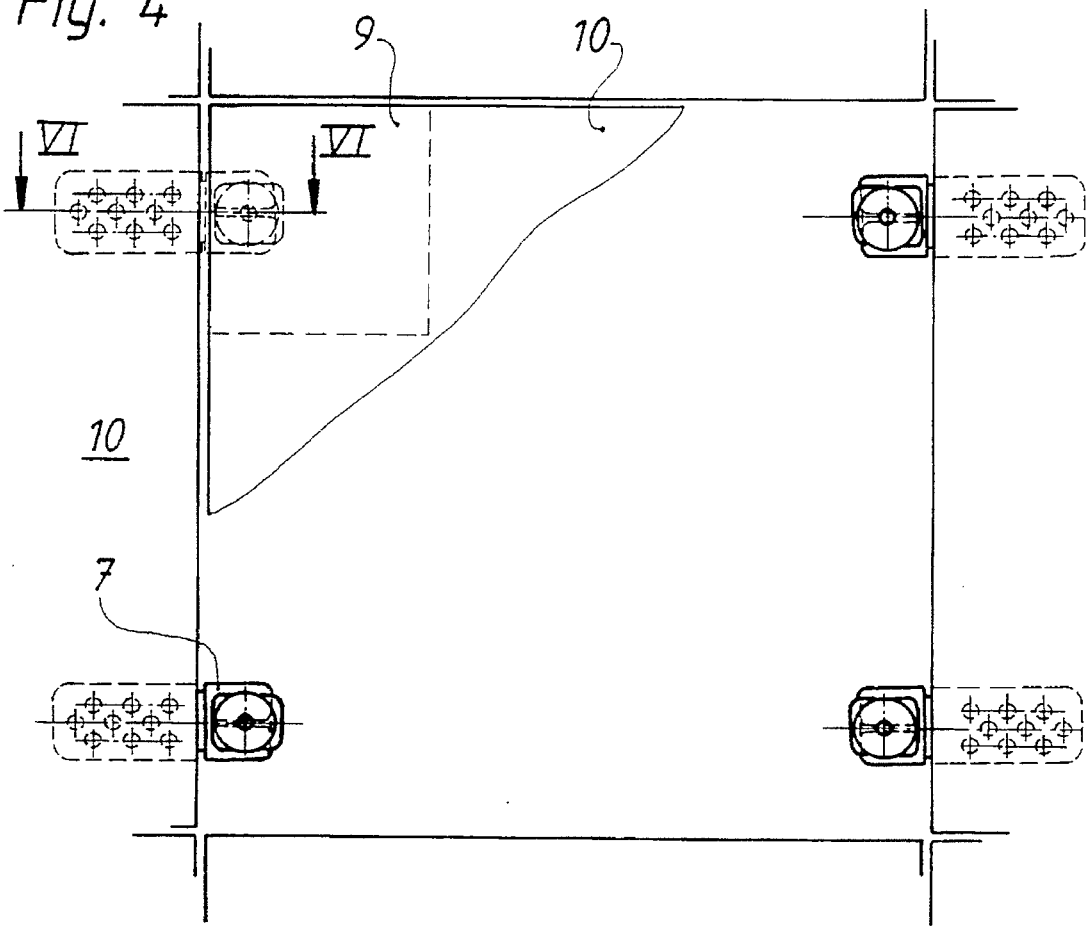
FIG. 4 shows in a top view the inventive apparatus, with the holding members for the permanent magnets in connection with anchoring members separately anchorable in the masonry.
Figure 5:
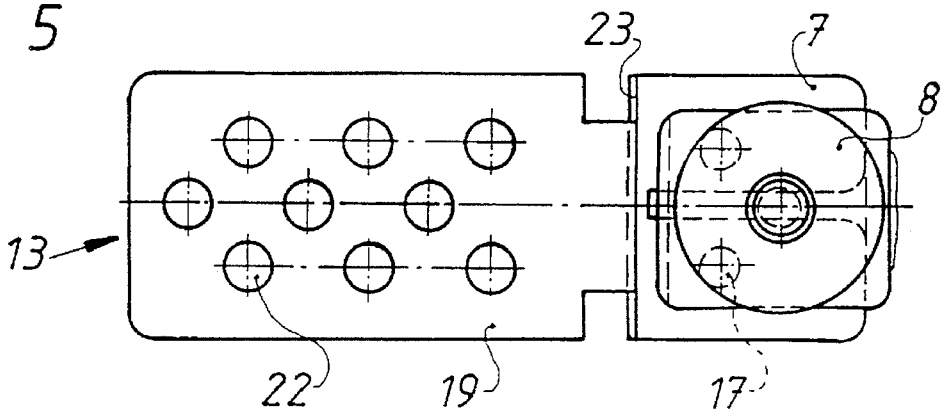
FIG. 5 shows in an enlarged scale a further holding member with an anchoring member in top view and FIG. 6 shows a section taken along the line VI—VI of FIG. 4, the holding member and the anchoring member being shown in the scale according to FIG. 5.
Figure 6:
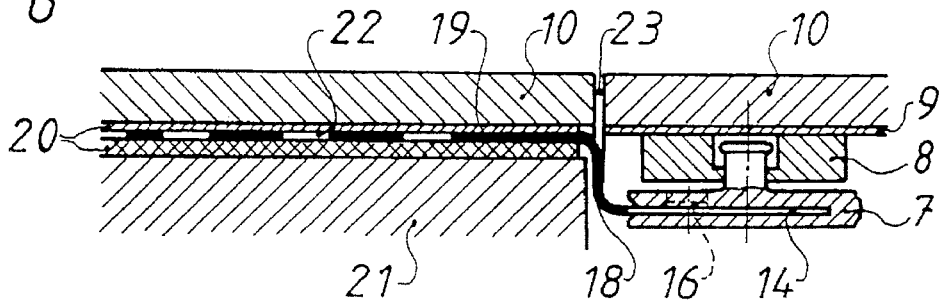

As it can be seen from FIGS. 2 and 3, the protrusion comprising the threaded bolt 6 is connected to the holding member 7 by means of a predetermined breaking line 12 so that the protrusion together with the threaded bolt 6 can be detached in a simple manner when a predetermined breaking force is applied to the protrusion. After detachment of the protrusion together with the threaded bolt 6, each holding member 7 can be used in connection with an own anchoring member 13 which can be anchored in the masonry wall as this is shown in FIGS. 4 to 6. The anchoring member 13 comprises a plate-shaped section 14 (also referred to as "a free end shank portion") which can be inserted into a slot 15 (see FIG. 3) in the holding member 7. This can be referred to the "second connecting means" of the present invention. For an undisplaceable fixation of the plate-shaped section of the anchoring member 13 in the slot 15, the plate-shaped section comprises knobs 16 which lock into deepenings or recesses 17 formed by openings and disposed in the holding member 7 in the region of the slot 15. Thus, the described support frame assembly 1, 2 or said support shanks 13, 14, 18 present two exemplary embodiments of what is generally referred to as "support means comprising anchoring means (13) for anchoring the support means to said masonry in said opening to provide support elements (1, 14) projecting into the opening."

The plate-shaped section 14 passes into a fastening section 19 fixable on the masonry wall via a connection section 18 extending transversely to the plane of this plate-shaped section, which fastening section extends parallelly to the plate-shaped section 14. The fastening section 19 is inserted into the mortar bed or adhesive bed 20 by which the tile 10 neighbouring the opening is connected to the masonry 21. In order to improve the anchoring of the fastening section 19, apertures 22 are provided in this fastening section 19, which are penetrated by the mortar or, respectively, by the adhesive.

By displacing the plate-shaped section 14 inserted into the slot 15 backwardly with respect to the fastening section 19, a space is formed for accommodating the permanent magnet 8 and it is ensured that the tile 10 connected to the masonry 21 is flush with the tile 10 constituting the cover member.

The connection section 18 is provided with upwardly protruding tongues 23 which define the distance between the tile 10 connected to the masonry and the tile 10 constituting the surface of the cover member, and, therefore, the thickness of the joint.

The embodiment shown in the drawing is provided with small plates 9 of ferromagnetic material only in the region of the permanent magnets 8 on the inner side of the tile 10. However, also the entire opening in the masonry to be covered, or at least a greater part thereof can be covered by a single plate of ferromagnetic material, which in this case constitutes a carrier to which also some tiles or plates can be pasted on. Thus, to summarize, the device of the present invention comprises a cover member 10 having an outer surface and an inner surface. The outer surface of the cover member 10 has a surface treatment complementary with that of the facing of tiles or plates. The inner surface of the cover member 10 comprises a ferromagnetic surface portion 9 extending over at least a part of the overall area of the inner surface. The device further comprises support means comprising anchoring means (e.g., bolt 6 or anchoring member 13) for anchoring the support means to the masonry wall 21 in the opening of the wall, and support elements 4, 14 projecting from the support means into the opening.

The support means of the present invention, through one holding member 7, is anchored to one of the following: a support frame assembly (i.e., frame corners 1 and connection elements 2), or a plurality of support shanks 14. First, the support frame assembly is adapted to be anchored in the masonry underneath the respective facing tiles or plates. The assembly includes peripheral strip means 2 arranged to extend, in an applied state, peripherally of and in a generally flush fashion with inside walls of the opening, and a plurality of brackets 1. The brackets 1 are complementary with the strip means 2 for attachment to the strip means 2 such that, in an applied state, each bracket 1 extends from the respective side wall or from a corner between adjacent walls, transversely inwardly into the opening thus forming a first embodiment of the support elements, namely protrusion 4.

Second, the anchoring members 13 have each an anchor portion 19 adapted to be embedded in the masonry underneath the respective facing of tiles or plates surrounding the respective opening, and a tree end shank portion 14 adapted to project from the respective inside wall into the opening. Thus, in a second embodiment of the present invention, support elements are embodied in the shank portions 14.

A plurality of holding members 7 each comprises a carrier section (adapted to receive anchor portion 14), and a permanent magnet 8 compatible with the ferromagnetic surface portion 9 of the respective cover member 10. Each holding member 7 further comprises first connecting means (e.g., bolt 6 which is received in threaded bore 5 of the protrusion 4) compatible with the support frame assembly of the support elements 4 for fixedly securing the carrier section of the holding member 7 to the respective bracket 2. The holding members 7 also each comprise second connecting means, distinct from the first connecting means and compatible with the plurality of support shanks 14 of the support elements, for fixedly securing the carrier section of each holding member 7 to the respective free endshank portion 14. The arrangement is such that the holding members 7 can be fixedly secured to any one of two types of the support means.

More specifically, the first connecting means includes forming the holding member 7 with a lateral projection integral with the carrier section, the lateral projection being provided with a threaded stem (e.g., bolt 6) compatible with a threaded opening 5 in the first connecting means. As shown in FIG. 3, the bolt 6 (or stem) is pivotable but axially fixed relative to the lateral projection and being so oriented that, on application, its axis is generally perpendicular to the respective masonry wall 21. The arrangement is such that the spacing between the first connecting means and the carrier section is adjustable in the direction along the opening by threading the stem 6 to a selected angular position in the associated threaded opening 5.

The second connecting means of the present invention is a slot 15 provided in the carrier section of the holding member 7. The slot 15 is lockably compatible with a respective support shank 14 to permit sliding of the carrier section of the holding member 7 onto the free end shank portion 14 and locking of the two to each other. The holding member 7 is provided with a line of weakness 12 between the lateral projection and the carrier section which facilitates the breaking-away of the lateral projection from the carrier section to reduce the overall size of the holding member 7 while utilizing the second connecting means. "Wall means" defining the slot 15 are provided with either locking protrusions and/or depressions compatible with locking depressions and/or protrusions, respectively, of the associated support shank 14. In the shown embodiment of FIG. 6, the shank portion 14 has knobs or protrusions 16 which are received in deepenings or depressions 17 formed in the walls defining the slot 15.

Each anchoring member 13 comprises a generally flat anchor tab 19 and an intermediate step portion 18 connecting the anchor tab 19 with the free end shank portion 14. The free end shank portion 14 has the shape of a generally flat support tab, whereby, upon installation, the anchor tab 19 is located on a plane which is closer to the surface of the respective masonry wall 21 than a second plane in which the free end shank portion 14 is located. The anchoring member 13 further comprises a flat tongue 23 generally co-planar with the step portion 18 and projecting generally at right angle to the anchor tab 19 from that surface of the anchor tab 19 which faces away from the support shank portion 14. Preferably, the anchor tab 19 is perforated to improve the anchoring thereof in the masonry wall 21.

I claim:

1. A kit for covering an opening in a masonry wall, said wall being provided with a facing of tiles, said kit comprising:

a cover member having an outer surface and an inner surface, said outer surface having a surface treatment complementary with that of said facing of tiles, said inner surface having a ferromagnetic surface portion extending over at least a part of the overall area of the inner surface;

a first support means, a second support means, and said first and second support means each comprising anchoring means for anchoring the respective support means to said masonry in said opening; and at least one holding member comprising a carrier section and a permanent magnet compatible with said ferromagnetic surface portion of the cover member, said holding member further comprising first connecting means compatible with said first support means and including a lateral projection integral with the carrier section and provided with a threaded stem compatible with a threaded opening in the first connecting means, said stem being pivotable but axially fixed relative to the lateral projection and being so oriented that, on application, its axis is generally perpendicular to the respective masonry wall, whereby the spacing between the first connecting means and the carrier section is adjustable in the direction along the opening by threading the stem to a selected position in the associated threaded opening, and second connecting means distinct from said first connecting means and compatible with said second support means, said second connecting means having a slot provided in the carrier section, said slot being lockably compatible with said second support means to permit sliding of the carrier section onto said support means and locking of the two to each other, whereby a single type of said holding member can be fixedly secured to said first or second support means.

2. A kit as set forth in claim 1, said first support means comprising support elements projecting from said anchoring means into the opening, said anchoring means having a support frame assembly adapted to be anchored in the masonry underneath the respective facing tiles or plates, said assembly including peripheral strip means arranged to extend, in an applied state, peripherally of and in a generally flush fashion with inside walls of the opening, a plurality of brackets, said brackets being complementary with the strip means for attachment to the strip means such that, in an applied state, each bracket extends from the respective side wall or from a corner between adjacent walls, transversely inwardly into the opening.

3. A kit as set forth in claim 1, said second support means comprising at least one support shank having an anchor portion adapted to be embedded in the masonry underneath the respective facing of tiles or plates surrounding the respective opening, and a free end shank portion adapted to project from the respective inside wall into said opening.

4. A kit as set forth in claim 1, said holding member having a line of weakness provided between the lateral projection and the carrier section which facilitates the breaking-away of the lateral projection from the carrier section to reduce the overall size of the holding member while utilizing the second connecting means.

5. A kit as set forth in claim 3, wherein wall means defining said slot are provided with locking protrusions or depressions compatible with locking depressions or protrusions, respectively, of the associated support shank.

6. A kit as set forth in claim 2, wherein each support shank comprises a generally flat anchor tab and an intermediate step portion connecting the anchor tab with the free end shank portion, the free end shank portion having the shape of a generally flat support tab, whereby, upon installation, the anchor tab is located on a plane which is closer to the surface of the respective masonry wall than a second plane in which the free end shank portion is located.

7. A kit as set forth in claim 6, wherein the support shank further comprises a flat tongue generally co-planar with the step portion and projecting generally at right angle to the anchor tab from that surface of the anchor tab which faces away from the support tab.

8. A kit as set forth in claim 7, wherein the anchor tab is perforated to improve the anchoring thereof in the masonry wall.

* * * * *